US005899568A

United States Patent [19]

Vonnahme

[11] Patent Number: 5,899,568

[45] Date of Patent: May 4, 1999

[54] MIXING TOOL

[75] Inventor: Rainer Vonnahme, Paderborn, Germany

[73] Assignee: Gebrüder Lödige Maschinenbau-Gesellschaft mbH, Paderborn, Germany

[21] Appl. No.: 09/005,037

[22] Filed: Jan. 9, 1998

[30] Foreign Application Priority Data

Feb. 19, 1997 [DE] Germany ..... 197 06 364

[51] Int. Cl.[6] ..... B01F 7/00

[52] U.S. Cl. ..... 366/325.1

[58] Field of Search ..... 366/64–66, 96–99, 366/102–104, 279, 325.1, 325.92, 342, 343

[56] References Cited

U.S. PATENT DOCUMENTS

| | | | |
|---|---|---|---|
| 2,017,116 | 10/1935 | Bonnell . | |
| 2,802,650 | 8/1957 | Straight | 366/343 |
| 4,214,376 | 7/1980 | Lücke et al. . | |
| 4,229,110 | 10/1980 | Lucke | 366/343 |
| 4,650,343 | 3/1987 | Doom et al. . | |
| 4,674,887 | 6/1987 | Lucke et al. | 366/325.1 |
| 4,848,919 | 7/1989 | Lipp et al. . | |
| 5,061,082 | 10/1991 | Steele, Jr. | 366/343 |
| 5,707,145 | 1/1998 | Lucke et al. | 366/325.1 |

FOREIGN PATENT DOCUMENTS

| | | |
|---|---|---|
| 2177638 | 11/1973 | France . |
| 2317068 | 2/1977 | France . |
| 1101113 | 3/1961 | Germany . |
| 2643560 | 3/1978 | Germany . |
| 2942325 | 4/1981 | Germany . |
| 3034200 | 4/1982 | Germany . |

*Primary Examiner*—Charles E. Cooley
*Attorney, Agent, or Firm*—Paul Vincent

[57] ABSTRACT

A mixing tool 10 for bulk material and/or similar materials for attachment onto a shaft 11 in a drum of a mixer has mixing tool surfaces $F_1$ 17 and $F_2$ 18 which extend radially from the shaft 11 nearly up to the inner wall of the mixer. The mixing tool surfaces $F_1$ 17 and $F_2$ 18 are distinguished by tool profile surfaces $F_{P1}$ and $F_{P2}$ which are generated by a cut through a penetration body in the x-z-plane formed by moving the mixing tool surfaces $F_1$ 17 and $F_2$ 18 formed on the mixing tool 10 through the material to be processed. The mixing tool surfaces $F_1$, $F_2$ are formed in such a fashion that they span surfaces defined by factors $c_1$ and $c_2$ in dependence on the radius of the drum, and the material volume flows from the mixing tool surfaces $F_1$ 17 and $F_2$ 18 back into the material to be processed are preferentially equal and oppositely directed parallel to the axis. The tilting of the mixing tool surfaces $F_1$ 17 and $F_2$ 18 is defined by an angle $\alpha$ and an angle $\beta$.

5 Claims, 5 Drawing Sheets

MIXING TOOL

This application claims Paris Convention Priority of German patent application 197 06 364.0 filed Feb. 19, 1997 the complete disclosure of which is hereby incorporated by reference.

BACKGROUND OF THE INVENTION

The invention concerns a mixing tool for bulk materials and/or similar materials for attachment to a shaft in a drum of a mixer, drier and/or reactor with a first mixing tool surface $F_1$ acting on the bulk material during rotation of the shaft which is associated with a first tool profile surface $F_{P1}$ and with a second mixing tool surface $F_2$ radially displaced therefrom which is associated with a second mixing tool profile surface $F_{P2}$, wherein the first and second mixing tool profile surfaces $F_{P1}$ and $F_{P2}$ extend in a radial direction from the surface of the shaft in a mutually adjacent non-separated fashion.

A mixing tool of this kind has become known in the art through DE 29 42 325 C2.

In order to process bulk materials rapidly and homogeneously it is necessary for the individual bulk material particles to be exchanged among each other in an intensive manner and as evenly as possible. With a plurality of conventional mixing tools consisting essentially of a holding arm and a mixing body, differing motional dependences can be produced in a material bed which depend essentially on the geometrical configuration of the mixing body.

The geometrical shapes of the conventional mixing bodies are generally adjusted to the kind of material processing, namely in dependence on whether or not the material is to be processed with a plough tool (push mixer), in a mechanically produced spiral bed (plough share mixer) or in a product ring (centrifugal mixer). Different types of processing result in the most differing of processing times and product qualities after processing.

A mixing tool is known in the art from DE 29 42 325 C2 which has a first mixing tool surface and a second mixing tool surface. These mixing tool surfaces directly border each other in a radial direction and extend from a mixer shaft nearly up to the inner wall of the drum. Conventional mixers strive to break-up a dried product for facilitating as intensive an exchange as possible with heated contact surfaces of the drum or with a gas stream of increased temperature flowing through the drum. The mixing surfaces of the conventional mixing tool are wedge-shaped and have surfaces which are not adapted to another. The conventional mixing tool is distinguished in that it initially extends in a rod-like fashion radially from the mixing shaft and maps, in the vicinity of the inner wall of the drum, into a rod extending parallel to the shaft.

Another mixing device is known in the art from DE-AS 1 101 113 having mixing tools with tool surfaces which are separated from another. These tool surfaces (pair-wise disposed centrifugal scoops) each move a product to be processed in opposite transport directions.

It is the underlying purpose of the present invention to further improve the conventional mixing tool in such a manner that the motion of the materials to be processed in a drum, as seen over the cross-section of the drum, is improved independent of the angular rotation of the shaft both with regard to an axially directed material exchange as well as with respect to a radial directed material exchange.

SUMMARY OF THE INVENTION

This purpose is achieved through the following dimensioning of the mixing tool in accordance with the invention in that the penetration volumes $V_{DP1}=2\pi\cdot r_{P1}\cdot F_{P1}$, $V_{DP2}=2\pi\cdot r_{P2}\cdot F_{P2}$ produced by the mixing tool surfaces $F_1$, $F_2$ of the mixing tool in the bulk material have the following mutual relationship $$r_{P1}\cdot F_{P1}=k\cdot r_{P2}\cdot F_{P2},$$

wherein k is a constant>0.3 and≦1 and the slanting of the mixing tool surfaces $F_1$, $F_2$ in an x-y-z-coordinate system is defined by $\alpha_1$, $\beta_2$ at each point of the first mixing tool surface and $\alpha_2$, $\beta_2$ at each point of the second mixing tool surface with the values $0°<\alpha_1<70°$ $0°<\beta_1<90°$ $0°<\alpha_2<70°$ $0°<\beta_2<90°$ and that the mixing tool surfaces $F_1$, $F_2$ obey the following surface formula $$F_1=c_1\cdot R \text{ and } F_2=c_2\cdot R,$$

wherein the factors $c_1$ [cm] and $c_2$ [cm] are defined within the following values 2 cm<$c_1$≦36 cm 3 cm<$c_2$≦18 cm.

In the mixing tool in accordance with the invention, the mixing tool surfaces $F_1$, $F_2$ are defined in $cm^2$ and the drum radius R has the dimensions of cm.

The mixing tool in accordance with the invention is represented in a x-y-z-coordinate system, wherein the z-axis travels through the shaft (is coincident with the shaft axis) and spans a horizontal projection plane together with the x-axis (see FIG. 1 and FIG. 4 of the description). The y-axis runs perpendicular to the horizontal projection plane, extends with positive values out of this plane and defines, together with the x-axis, the plane of motion of the mixing tool in accordance with the invention.

The tool profile surfaces $F_{P1}$ and $F_{P2}$ are additional surfaces for defining the mixing tool in accordance with the invention. These are the corresponding surfaces of a cut in the x-z-plane through a penetration body which is generated by moving the mixing tool surface formed on the mixing tool through the product to be processed (rotation about the shaft).

$r_{P1}$ and $r_{P2}$ designate the separation in cm from the z-axis (shaft axis) to the center of gravity of the tool profile surfaces $F_{P1}$ and $F_{P2}$.

k is a constant and varies between 0.3 to 1, depending on the surface distribution of the tool profile surfaces $F_{P1}$ and $F_{P2}$.

The angles α, β describe the tilt of the tool surfaces $F_1$, $F_2$ at an arbitrarily chosen surface point in two mutually perpendicular directions. The angle α describes the acute angle between the y-axis and the tangent to the line of intersection between the tool surface and a plane parallel to the y-z plane at the chosen surface point. That is, α is the angle between the positive y-direction and the orientation, in the z-direction, of the mixing tool surface lying in the positive y-direction. The angle β designates the acute angle between the y-axis and the tangent to the line of intersection between the tool surface and a plane parallel to the x-y plane at the chosen surface point. That is, β is the angle between the positive y-direction and the orientation of the mixing tool surface in the positive x-direction.

The mixing tool in accordance with the invention has the advantage that it dives into the material to be processed during rotation about the shaft with mixing tool surfaces which are directed radially and extend along the entire length of the mixing tool in the direction of the x-axis. In this manner a material accumulation present in the drum can be effectively processed at the most differing of rotational speeds of the shaft, i. e. mixed. The processing times are optimized for mixing using a plough tool, a mechanically produced spiral bed and a product ring. Uniform partial motions can be effected throughout the entire height of the material accumulation even for low rotational rates (gentle product treatment) leading to improved mixing quality and shorter mixing times.

The mixing tool in accordance with the invention extends from the shaft up to the inner wall of the drum and has only a small separation with respect to the inner surface of the drum.

The tool profile surfaces $F_{P1}$ and $F_{P2}$ as well as their center of gravity coordinates $r_{P1}$ and $r_{P2}$ are to be chosen in such a fashion that the material volume stream departing from the surface $F_1$ is equal to or larger than k-times, or preferentially equal to, the material volume stream departing from the surface $F_2$. In addition, the tilt angles $\alpha$ and $\beta$ of the mixing tool surfaces $F_1$ and $F_2$ are to be chosen in such a fashion that the material to be processed glides along the mixing tool surfaces to prevent back-up accumulation. The tilt angles $\alpha$ and $\beta$ are likewise to be chosen in such a fashion that the material mass flow departing from the mixing tool surfaces are directed diametrically with respect to each other and, preferentially, parallel to the axis.

If the axial surface edge of the first mixing tool surface $F_1$ ends in the z-direction and continues in the same direction into the second mixing tool surface $F_2$ without having an overlap between the mixing tool surfaces $F_1$ and $F_2$ in the z-direction (see FIG. 2), the material volume flow departing from the mixing tool surface $F_2$ is not captured by the mixing tool surface $F_1$. The material volume flows incident during motion of the mixing tool onto the mixing tool surfaces $F_1$ and $F_2$ are thereby equal to the material volume flows departing from the mixing tool surfaces $F_1$ and $F_2$.

The material volume flow departing from the surface $F_1$ is, in this case, equal to k-times the material volume flow departing from the surface $F_2$. In a preferred case, k=1 so that the departing volume flows are of equal magnitude.

If, in an additional embodiment, the mixing tool surfaces $F_1$ and $F_2$ are disposed in such a fashion that the material volume flow departing from the mixing tool surface $F_2$ is partially incident on the mixing tool surface $F_1$, it is then possible for the mixing tool surfaces $F_1$ and $F_2$ to be configured such that k<1. The material volume flow departing from the surface $F_1$ is then larger than k-times, and at most equal to, the material volume flow departing from surface $F_2$. Therefore, the preferred condition that the departing material volume flows are of equal magnitude can also be achieved for the case of k<1 so that a homogeneous mixing of the material can be achieved with the shortest of processing times.

If, in accordance with a further embodiment of the invention, the mixing tools are distributed along the shaft about the periphery of the shaft so that a plurality of mixing tools are provided in the drum for processing of the material located in the drum, these mixing tools can also work together so that, for example, mixing tool surfaces $F_2$ trigger a material direction deflection supporting the natural material flow and the mixing tool surfaces $F_1$ transport the material volume flow incident thereon in opposition to the deflection direction of the mixing tool surfaces $F_2$. Between these extreme direction deflections of the material to be processed by the mixing tool surfaces $F_1$ and $F_2$, deflection directions caused by the surfaces $F_1$ and $F_2$ are conceivable which only partially enhance material transport or return.

In addition to the embodiments of the mixing tool in accordance with the invention described with which, in a radial direction, a more or less wider transition region between the mixing tool surfaces $F_1$ and the mixing tool surfaces $F_2$ obtains, other embodiments are advantageous with which at least one of the two mixing tool surfaces $F_1$ and $F_2$ extends from the shaft or from a more outer-lying position nearly up to the drum so that the mixing tool surfaces $F_1$, $F_2$ map into each other in the axial direction.

In an additional configuration of the invention, the mixing tool surfaces are curved in a convex and/or concave fashion.

In the event that the angles $\alpha$ and $\beta$ are constant at each point on the mixing tool surfaces $F_1$ and $F_2$ under consideration, i. e. position independent, a planar mixing tool surface is defined. If, however, in a preferred configuration, the angles $\alpha$ and $\beta$ are different at each point of the mixing tool surfaces $F_1$ and $F_2$ under consideration, the mixing tool surfaces $F_1$ and $F_2$ are curved: i. e. the angles $\alpha$ and $\beta$ differ at each point of the mixing tool surfaces $F_1$ and $F_2$ under consideration (position-dependent angle).

In order to guarantee a directed deflection of the material being processed along the mixing tool surfaces $F_1$ and $F_2$, the so-called incident angle $\delta$, i. e. the angle between the material volume flow incident on the mixing tool surfaces $F_1$ and $F_2$ and that departing from these surfaces, is not larger than a limiting angle $\delta_g$ corresponding to the internal frictional angle of the material being processed. If $\delta$ is larger, an additional material volume (back-up) is formed in front of the mixing tool surfaces $F_1$ and $F_2$ which leads to increased power consumption of the mixer. With the tool in accordance with the invention or with the tools in accordance with the invention, this increased power consumption is avoided and the material to be processed does not act on the mixing tool surfaces $F_1$ and $F_2$ with increased resistance.

A mixer whose shaft is equipped with the mixing tools in accordance with the invention has drive mechanisms for rotating the shaft and the mixing tools attached thereto. The rate of revolution n of the shaft is given in $sec^{-1}$.

In a preferred embodiment of the invention, the first section of the mixing tool sweeps out a first material volume flow $\dot{V}_1$ and the second section of the mixing tool sweeps out a second material volume flow $\dot{V}_2$ during rotation of the shaft. The relationship between these two volume flows is given by the following formula:

$$\dot{V}_1=2\pi n\ (r_{P1}\cdot F_{P1}+a\cdot r_{P2}\cdot F_{P2}) \text{ and}$$

$$\dot{V}_2=2\pi n\ (r_{P2}\cdot F_{P2}-a\cdot r_{P2}\cdot F_{P2}),$$

with n being the rate of rotation of the shaft and being a factor between 0 and 0.35 specifying a fractional volume flow produced by the second section and passed to the first section. In this embodiment $\dot{V}_1$ is less than or equal to $\dot{V}_2$ and greater than or equal to $k\cdot\dot{V}_2$, wherein $k\leqq 1-2a$.

An improvement in a preferred embodiment of the invention provides that the first surface $F_1$ pushes, throws or presses bulk material in a transport direction diametrically opposed to a transport direction of the material processed by the second surface $F_2$.

Further advantages can be derived from the description and the accompanied drawing. The above mentioned features and those to be described further below can be utilized in accordance with the invention individually or collectively in arbitrary mutual combination.

The mixing tools shown in the figures are not to be taken to scale and are shown in a highly simplified fashion.

DESCRIPTION OF THE PREFERRED EMBODIMENT

Figure 1:
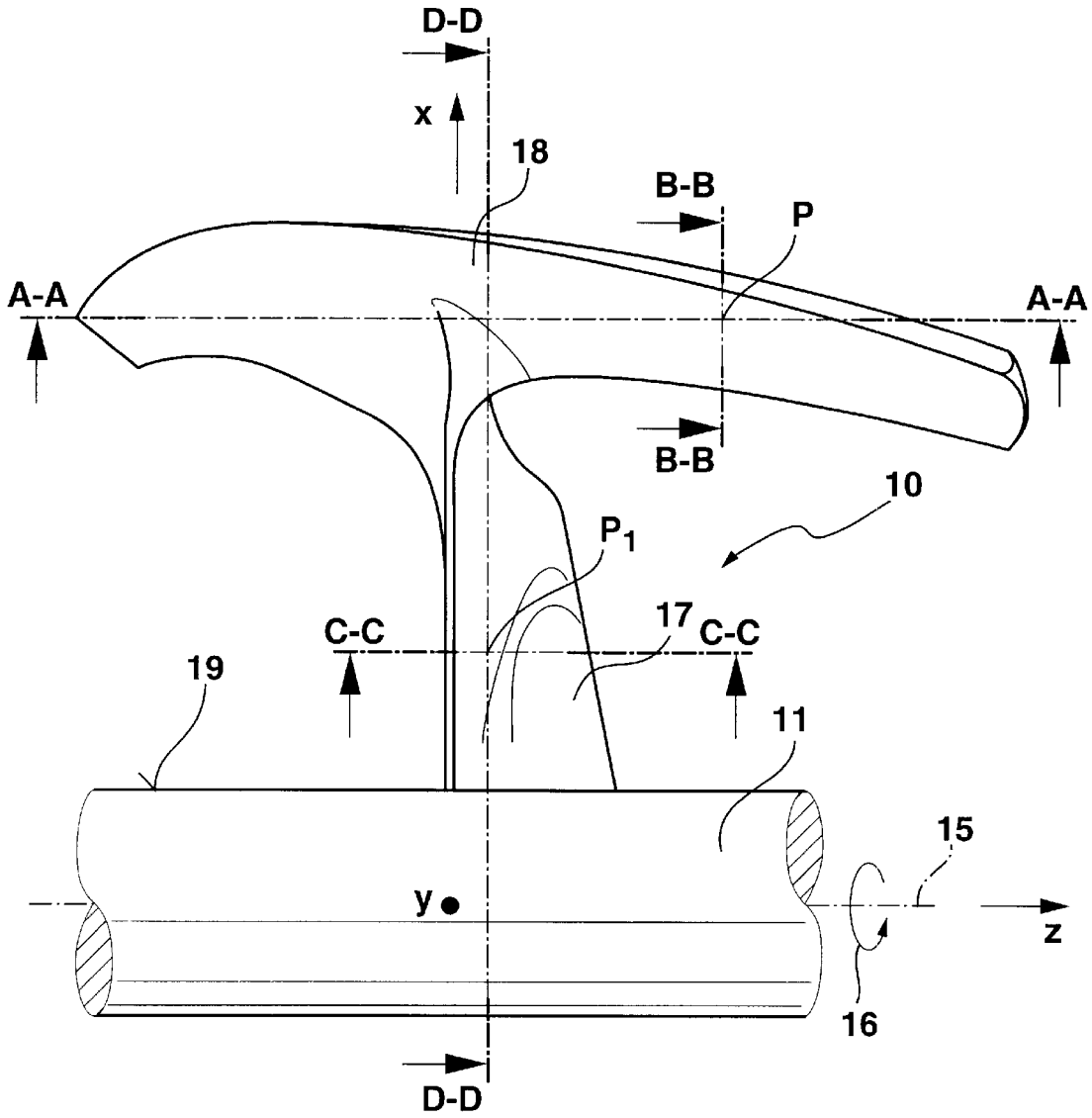
FIG. 1 shows a mixing tool in accordance with the invention and its attachment to a shaft.

FIG. 1 shows a mixing tool 10 attached to a shaft 11.

The shaft 11 is borne in a rotatable fashion in head pieces of a drum not shown in the figure. The shaft 11 has an axis 15 (axis of rotation) about which the shaft 11 can rotate in the direction of arrow 16.

The mixing tool 10 comprises a first mixing tool surface $F_1$ 17 and a second mixing tool surface $F_2$ 18. The mixing tool 10 is mounted to the surface 19 of the shaft 11. The mixing tool 10 can be screwed or welded onto the shaft 11.

The mixing tool 10 has a coordinate system x-y-z partially indicated in the figure. The z-axis is coincident with the axis 15 and the x-axis extends perpendicular to the z-axis in the plane of the figure. The y-axis extends with positive values out of the plane of the figure and is likewise perpendicular to the x- and z-axis. When the mixing tool 10 rotates with a rate of revolution n about the axis 11, it rotates in the motional plane subtended by the coordinate axes x and y. The mixing tool surface $F_2$ 18 extends axially in both the negative and positive z-axis directions. In this manner, a particular material volume flow departing from the mixing tool surface $F_2$ is transferred to the mixing tool surface $F_1$. The mixing tool surfaces $F_1$ and $F_2$ 17, 18 are configured in such a fashion that the penetration volumes $V_{DP1}$ and $V_{DP2}$ produced by the mixing tool surfaces $F_1$, $F_2$ 17, 18 of the mixing tool 10 in the bulk material or in the material to be processed have the following mutual relationship:

$$r_{P1} \cdot F_{P1} = k \cdot r_{P2} \cdot F_{P2}.$$

with, in this relationship, k<1. The mixing tool surfaces $F_1$ are thereby chosen in such a fashion that their axial extent decreases in the radial direction from the shaft 11 towards the inner wall of the drum.

Figure 1A:
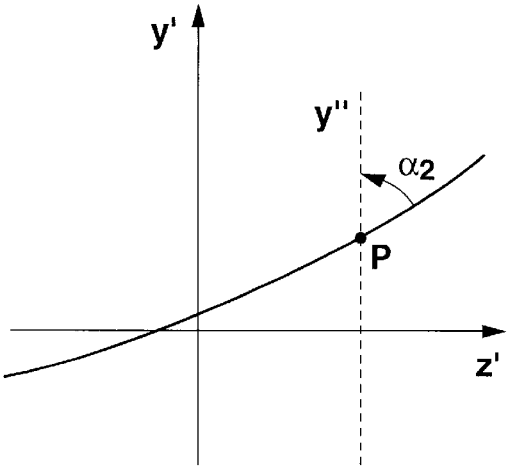
FIG. 1*a* shows the definition of the angle $\alpha_2$.
Figure 1B:
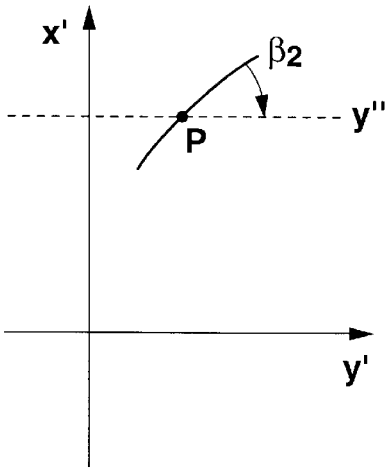
FIG. 1*b* illustrates the definition of $\beta_2$.
Figure 1C:
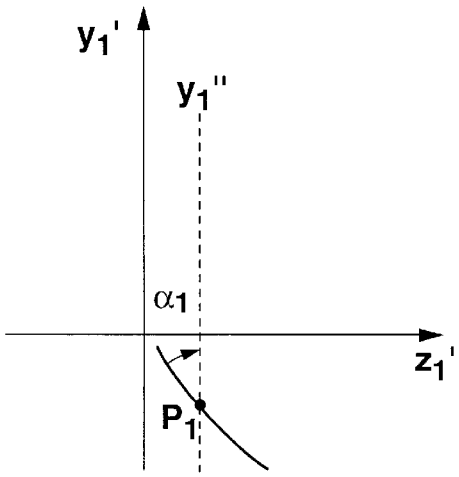
FIG. 1*c* illustrates the definition of $\alpha_1$.
Figure 1D:
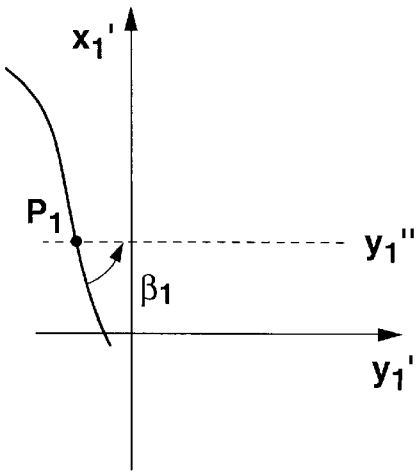
FIG. 1*d* illustrates the definition of $\beta_1$.

FIGS. 1*a*, 1*b*, 1*c*, and 1*d* illustrate the definition of the angles $\alpha_2$, $\beta_2$, $\alpha_1$, and $\beta_1$ respectively. With regard to FIG. 1*a*, the angle $\alpha_2$ is defined as the angle between a tangent to a line of intersection between a plane parallel to the y-z plane (indicated in FIG. 1*a* as y'-z') and the y-axis through the point P (indicated in the diagram as y"). FIG. 1*b* shows $\beta_2$ to be the angle between a tangent to a line of intersection between the tool and a plane parallel to the x-y plane through the point-P and the y direction. The plane parallel to the x-y plane is indicated in FIG. 1*b* as x'-y', and the y-direction through the point P as y". FIG. 1*a* therefore corresponds to the cut A—A illustrated in FIG. 1, and FIG. 1*b* the cross-sectional cut through the tool corresponding to B—B of FIG. 1. With regard to the tool surface proximate to the shaft, FIGS. 1*c* and 1*d* illustrate the definition using a point $P_1$ as indicated in FIG. 1 and, analogous to FIG. 1*a*, the angle $\alpha_1$ at point $P_1$ is indicated as that angle between a plane parallel to the y-z plane, (here indicated $y_1'$-$z_1'$), and the z-axis through the point $P_1$ (indicated $y_1''$) corresponding to cut C—C of FIG. 1. FIG. 1*d*, analogous to FIG. 1*b*, illustrates the definition of the acute angle $\beta_1$ as that angle between the tangent at the point $P_1$ in a plane parallel to the x-y plane (defined in FIG. 1*d* as $x_1'$, $y_1'$ and the y-direction through the point P' (defined in FIG. 1*d* as $y_1''$) corresponding to cut D—D of FIG. 1.

Figure 2:
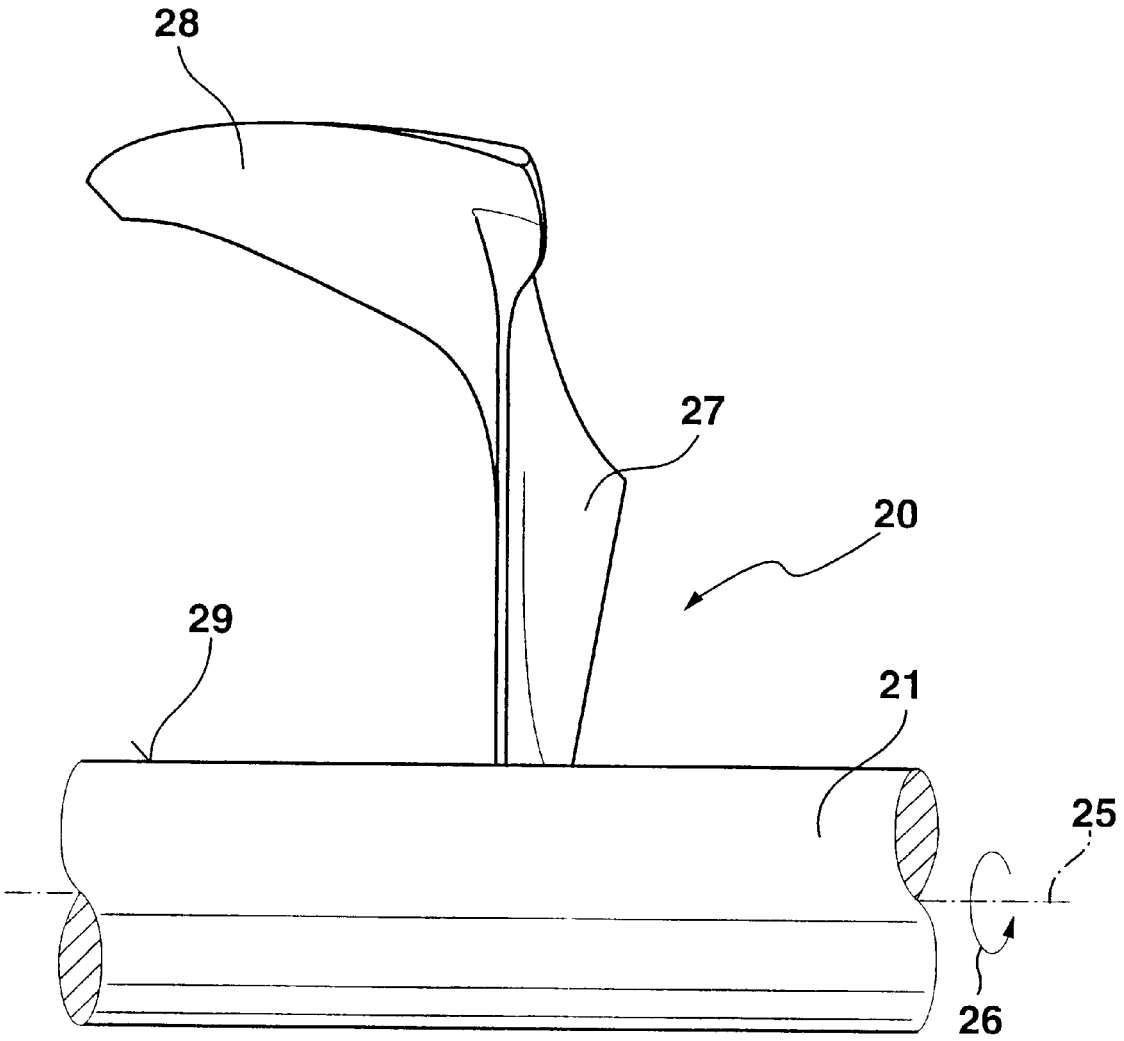
FIG. 2 shows an additional mixing tool in accordance with the invention on a shaft.

FIG. 2 shows another configuration of the mixing tool 20 attached to a shaft 21. The shaft 21 has an axis 25 rotatable in the direction of arrow 26. When the shaft 21 rotates about the axis 25, the mixing tool 20 dives into the material to be processed. During this diving into the material to be processed, the mixing tool surfaces $F_1$ 27 and $F_2$ 28 move the material to be processed. The mixing tool surfaces $F_1$ 27 and $F_2$ 28 can be flat and/or curved. The mixing tool surfaces $F_1$ 27 and $F_2$ 28 produce penetration volumes $V_{DP1}$ and $V_{DP2}$ in the bulk material to be processed or in the product which are equal to each other for k=1. The mixing tool surfaces $F_1$ are thereby chosen in such a fashion that their axial extension increases in the radial direction from the shaft towards the drum.

Figure 3:
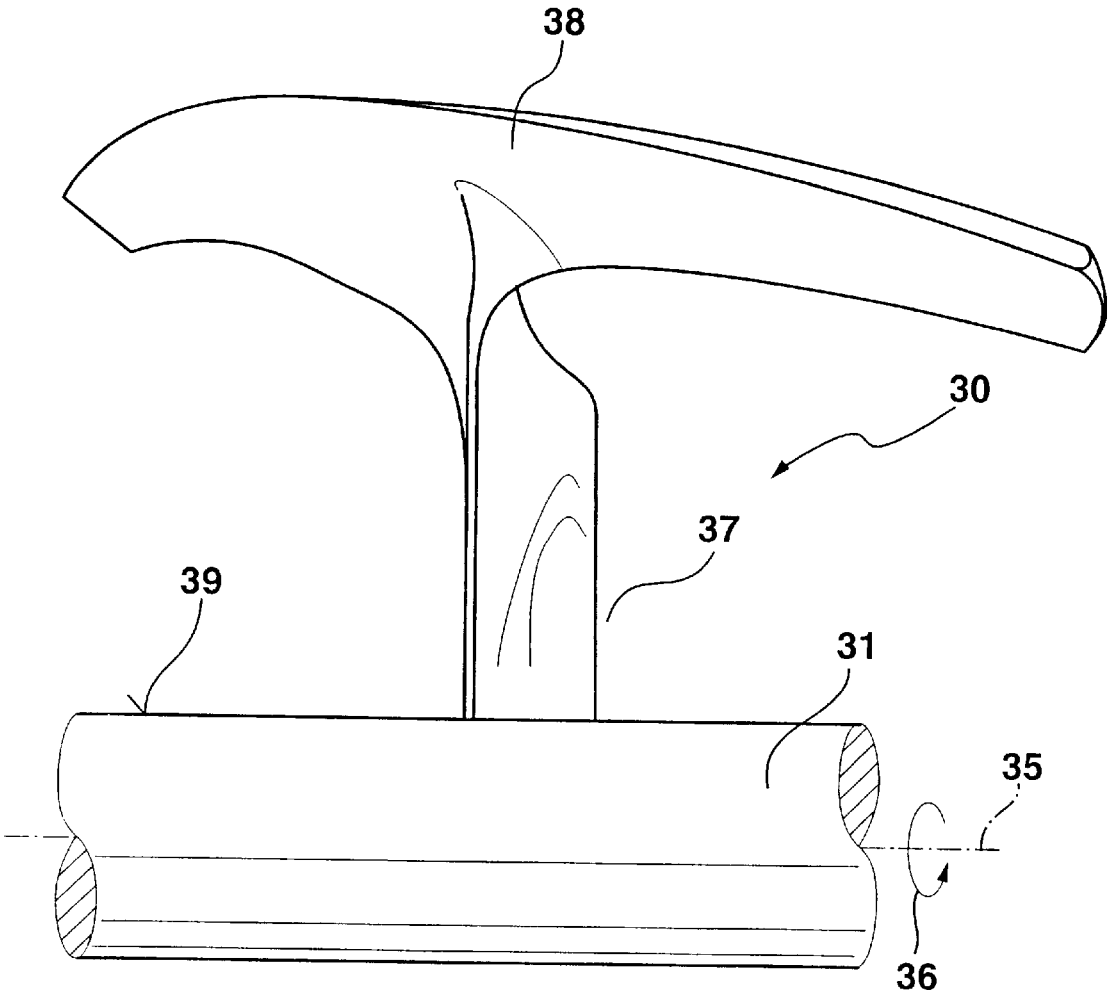
FIG. 3 shows a third embodiment of a mixing tool in accordance with the invention.

FIG. 3 shows another mixing tool 30 attached to a shaft 31. The shaft 31 has an axis 35 rotatable in the direction of arrow 36. The mixing tool 30 comprises a mixing tool surface 37, 38, wherein the first mixing tool surface $F_1$ 37 has an axial extent which is constant in the radial direction. The first mixing tool surface $F_1$ 37 extends radially with respect to shaft 31 and, at its end, maps into the second mixing tool surface $F_2$ 38 which, in this embodiment of the mixing tool 30, extends at both sides of the first mixing tool surface $F_1$ 37. The mixing tool surface $F_2$ 38 partly transports material volume flow incident thereon both onto the mixing tool surface $F_1$ 37 as well as into the adjacent free space in the drum of the mixer and into material accumulations in the vicinity of the mixing tool.

Figure 4:
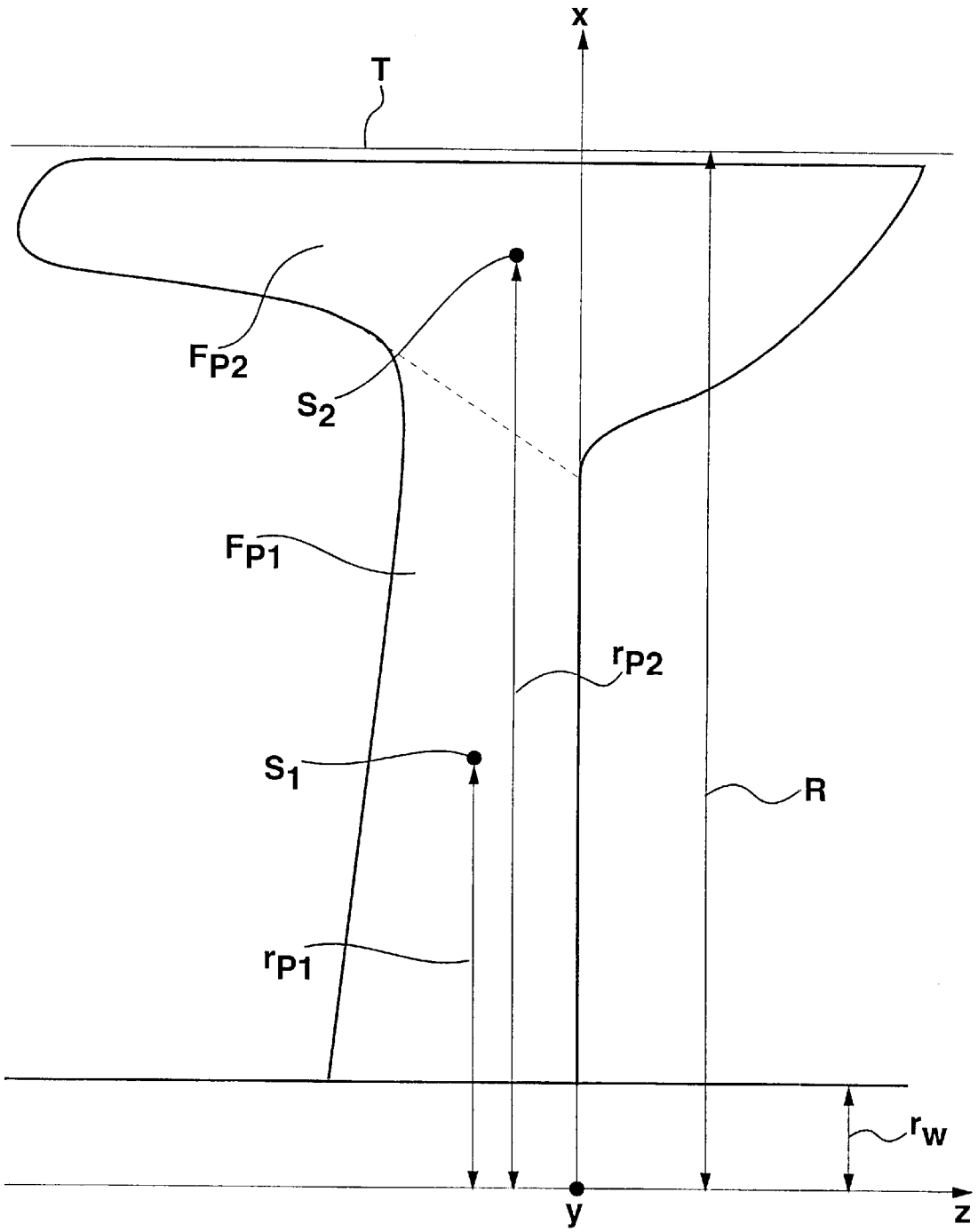
FIG. 4 shows mixing tool profile surfaces of a mixing tool in accordance with the invention having associated mixing tool surfaces $F_1$ and $F_2$.

FIG. 4 shows a mixing tool in accordance with the invention having tool profile surfaces $F_{P1}$ and $F_{P2}$ which represent auxiliary surfaces for the mixing tool surfaces $F_1$ and $F_2$. The mixing tool profile surfaces $F_{P1}$ and $F_{P2}$ are surfaces which result by a cut through a penetration body in the x-z-plane, wherein the cut ends on the axis of the shaft. The penetration body is thereby established by moving the mixing tool surface formed on the mixing tool through the material to be processed.

The coordinate system x-y-z shown in FIG. 4 extends, with its z-axis, through the axis of the shaft, the x-axis extends perpendicular to the z-axis and defines the plane of the drawing and the y-axis extends perpendicular to both the z-as well as to the x-axis and extends with positive y-values out of the plane of the drawing. The x-y-plane defines the plane of motion in which a moving tool rotates. $r_w$ defines the radius of the shaft. R defines the radius of the drum between the axis of the shaft and the inner wall of the drum. The mixing tool is disposed between the shaft and the inner wall of the drum and is defined in the figure by tool profile surfaces $F_{P1}$ and $F_{P2}$. $S_1$ is the surface center of gravity of the tool profile surface $F_{P1}$ and $S_2$ is the surface center gravity of the tool profile surface $F_{P2}$. $r_{P1}$ and $r_{P2}$ give the separation of the surface center of gravity $S_1$ and $S_2$ from the z-axis. The transition from the tool profile surface $F_{P1}$ to the tool profile surface $F_{P2}$ is drawn in the figure with dotted lines. T designates the wall of the drum.

For a drum having a radius of 39.5 cm a mixing tool in accordance with the invention, in a preferred embodiment, has a value of k=1, $c_1$=10.38 cm and $c_2$=5.7 cm, a mixing tool surface $F_1$ of 410 $cm^2$ and a mixing tool surface $F_2$ of 225 $cm^2$.

A mixing tool 10 for bulk material and/or similar materials for attachment onto a shaft 11 in a drum of a mixer has mixing tool surfaces $F_1$ 17 and $F_2$ 18 which extend radially from the shaft 11 nearly up to the inner wall of the mixer. The mixing tool surfaces $F_1$ 17 and $F_2$ 18 are characterized by tool profile surfaces $F_{P1}$ and $F_{P2}$ which are generated by a cut through a penetration body in the x-z-plane formed by moving the mixing tool surfaces $F_1$ 17 and $F_2$ 18 of the mixing tool 10 through the material to be processed. The mixing tool surfaces $F_1$, $F_2$ are formed in such a fashion that they span surfaces defined by factors $c_1$ and $c_2$ in dependence on the radius of the drum and the material volume flows from the mixing tool surfaces $F_1$ 17 and $F_2$ 18 flowing back into the material to be processed are preferentially equally large and oppositely directed parallel to the axis. The mixing tool surfaces $F_1$ 17 and $F_2$ 18 are defined with respect to their tilting by an angle $\alpha$ and an angle $\beta$.

I claim:

1. A mixing tool for a bulk material and similar materials, for radial attachment to a shaft in a drum of a mixer, dryer or reactor, the mixing tool having a point on a surface thereof, the surface having a shape defined by an angle $\alpha$ between a y-axis and a first tangent to a first line of intersection between the surface and a first plane parallel to a y-z plane at the point and an angle $\beta$ between the y-axis and a second tangent to a second line of intersection between the surface and a second plane parallel to an x-y plane at the point, wherein an x-axis, the y-axis, and a z-axis define a right handed Cartesian coordinate system, the z-axis passing through the shaft and the x-axis passing through the mixing tool, the mixing tool comprising:

a first section, the surface comprising a first surface $F_1$ at said first section containing the point and having the shape defined by a first angle $\alpha=\alpha_1$, and a first angle $\beta=\beta_1$, said first surface $F_1$ having a first surface projection $F_{P1}$ with a first center of gravity at a first radial separation $r_{P1}$ from the z-axis and having a first penetration volume $V_{DP1}=2\pi\cdot r_{p1}\cdot F_{P1}$ produced by said first section in the bulk material during rotation of the shaft; and a second section adjacent to said first section, the surface comprising a second surface $F_2$ at said second section containing the point and having the shape defined by a second angle $\alpha=\alpha_2$ and a second angle $\beta=\beta_2$, said second surface $F_2$ having a second surface projection $F_{P2}$ with a second center of gravity at a second radial separation $r_{p2}$ from the z-axis and having a second penetration volume $V_{DP2}=2\pi\cdot r_{p2}\cdot F_{P2}$ produced by said second section in the bulk material during rotation of the shaft, wherein $r_{p1}\cdot F_{P1}=k\cdot r_{p2}\cdot F_{P2}$, $0°<\alpha_1<70°$ $0°<\beta_1<90°$ $0°<\alpha_2<70°$ $0°<\beta_2<90°$ $F_1=c_1\cdot R$ $F_2=c_2\cdot R$ with $2\text{ cm}<c_1\leqq 36\text{ cm}$ $3\text{ cm}<c_2\leqq 18\text{ cm}$, R being a radius of the drum in cm and k a constant with $0.3<k\leqq 1$, wherein $c_2$ is substantially less than $c_1$.

2. The mixing tool of claim 1, wherein during rotation of the shaft, said first and second sections produce a first material volume stream $\dot{V}_1$ and a second material volume stream $\dot{V}_2$, wherein $$\dot{V}_1=2\pi n\,(r_{P1}\cdot F_{P1}+a\cdot r_{P2}\cdot F_{P2})\text{ and}$$

$$\dot{V}_2=2\pi n\,(r_{P2}\cdot F_{P2}-a\cdot r_{P2}\cdot F_{P2}),$$

wherein n is a rate of rotation of the shaft and a is a factor between 0 and 0.35 indicating a fractional volume flow produced by said second section and passed to said first section and $\dot{V}_1$ is less than or equal to $\dot{V}_2$, wherein $$k\leqq 1-2a$$

with $$\dot{V}_1\geqq k\cdot\dot{V}_2.$$

3. The mixing tool of claim 1, wherein said first surface $F_1$ pushes, throws or presses the bulk material in a transport direction which is diametrically opposed to a transport direction of material processed by said second surface $F_2$.

4. The mixing tool of claim 1, wherein said first and second surfaces $F_1$, $F_2$ are curved.

5. A mixing apparatus for a bulk material and similar materials, the apparatus having a plurality of mixing tools for radial attachment along and peripheral distribution about a shaft in a drum of the apparatus, the mixing tools each having a point on a surface thereof, the surface having a shaped defined by an angle $\alpha$ between a y-axis and a first tangent to a first line of intersection between the surface and a first plane parallel to a y-z plane at the point and an angle $\beta$ between the y-axis and a second tangent to a second line of intersection between the surface and a second plane parallel to an x-y plane at the point, wherein an x-axis, the y-axis, and a z-axis define a right handed Cartesian coordinate system, the z-axis passing through the shaft and the x-axis passing through each mixing tool, each mixing tool comprising:

a first section, the surface comprising a first surface $F_1$ at said first section containing the point and having the shape defined by a first angle $\alpha=\alpha_1$, and a first angle $\beta=\beta_1$, said first surface $F_1$ having a first surface projection $F_{P1}$ with a first center of gravity at a first radial separation $r_{p1}$ from the z-axis and having a first penetration volume $V_{DP1}=2\pi\cdot r_{p1}\cdot F_{P1}$ produced by said first section in the bulk material during rotation of the shaft; and a second section adjacent to said first section, the surface comprising a second surface $F_2$ at said second section containing the point and having the shape defined by a second angle $\alpha=\alpha_2$ and a second angle $\beta=\beta_2$, said second surface $F_2$ having a second surface projection $F_{P2}$ with a second center of gravity at a second radial separation $r_{p2}$ from the z-axis and having a second penetration volume $V_{DP2}=2\pi\cdot r_{p2}\cdot F_{P2}$ produced by said second section in the bulk material during rotation of the shaft, wherein $r_{p1}\cdot F_{P1}=k\cdot r_{p2}\cdot F_{P2}$, $0°<\alpha_1<70°$ $0°<\beta_1<90°$ $0°<\alpha_2<70°$ $0°<\beta_2<90°$ $F_1=c_1\cdot R$ $F_2=c_2\cdot R$ with $2\text{ cm}<c_1\leqq 36\text{ cm}$ $3\text{ cm}<c_2\leqq 18\text{ cm}$, R being a radius of the drum in cm and k a constant with $0.3<k<1$, wherein $c_2$ is substantially less than $c_1$.

* * * * *